US010932579B2

(12) United States Patent
Murphy

(10) Patent No.: US 10,932,579 B2
(45) Date of Patent: Mar. 2, 2021

(54) SEAT OCCUPANCY INDICATOR DEVICE AND METHOD

(71) Applicant: Terence Murphy, Saint Lazare (CA)

(72) Inventor: Terence Murphy, Saint Lazare (CA)

( * ) Notice: Subject to any disclaimer, the term of this patent is extended or adjusted under 35 U.S.C. 154(b) by 0 days.

(21) Appl. No.: 15/927,046

(22) Filed: Mar. 20, 2018

(65) Prior Publication Data

US 2019/0290009 A1 Sep. 26, 2019

(51) Int. Cl.
*G09F 7/18* (2006.01)
*A47C 7/72* (2006.01)
*A47C 1/14* (2006.01)

(52) U.S. Cl.
CPC ..... *A47C 7/725* (2013.01); *A47C 1/143* (2013.01)

(58) Field of Classification Search
CPC ..... A47C 7/725; A47C 1/143; B60N 2/26; B60N 2/002; G09F 7/18; F16B 2/22; F16M 13/005; F16M 13/022
See application file for complete search history.

(56) References Cited

U.S. PATENT DOCUMENTS 6,140,921 A * 10/2000 Baron ..... G08B 5/00 340/457
6,170,968 B1 * 1/2001 Caswell ..... B62J 6/20 362/276
6,189,968 B1 * 2/2001 Emanuel ..... A47C 1/13 297/188.01
6,242,872 B1 * 6/2001 Ha ..... H05B 47/16 315/293
8,565,044 B1 * 10/2013 Spiker ..... G04F 3/08 368/107
8,587,446 B2 * 11/2013 Hefferon ..... G08B 5/221 340/679
9,185,988 B1 11/2015 Sanchez
9,449,536 B1 * 9/2016 Sanner ..... G09F 7/18
2002/0126157 A1 * 9/2002 Farago ..... G01D 4/002 715/810
2005/0099787 A1 * 5/2005 Hayes ..... B60Q 11/002 362/20
2007/0156317 A1 * 7/2007 Breed ..... B60R 21/01516 701/45
2009/0108647 A1 * 4/2009 Bowman ..... A47C 31/11 297/217.1
2012/0026725 A1 * 2/2012 Johnson ..... F21L 4/00 362/154
2012/0080944 A1 * 4/2012 Recker ..... H05B 45/37 307/25
2013/0100652 A1 * 4/2013 Guinon ..... F21V 23/0492 362/184

(Continued)

*Primary Examiner* — An T Nguyen
(74) *Attorney, Agent, or Firm* — Argus Intellectual Enterprise; Jordan Sworen; Daniel Enea

(57) ABSTRACT

A seat occupancy indicator device and method; the seat occupancy indicator device includes a housing made of a rigid material (the housing has a housing-exterior and a housing-interior-volume); a plurality of indicator lights, the plurality of indicator lights disposed on the housing-exterior, the plurality of indicator lights viewable from a location outside of the housing; a control-circuit, the control-circuit located within the housing-interior-volume, the control-circuit communicatively coupled to the plurality of indicator lights. The seat occupancy indicator is useful for indicating occupancy of a seat.

14 Claims, 5 Drawing Sheets

(56) References Cited

U.S. PATENT DOCUMENTS

| | | | | |
|---|---|---|---|---|
| 2014/0125355 | A1* | 5/2014 | Grant | G01R 27/2605<br>324/629 |
| 2017/0101055 | A1* | 4/2017 | Alfaro Fonseca | B60C 9/00 |
| 2017/0127790 | A1* | 5/2017 | Huang | A45D 29/00 |
| 2017/0358182 | A1* | 12/2017 | El-Iraki | G08B 29/185 |

* cited by examiner

SEAT OCCUPANCY INDICATOR DEVICE AND METHOD

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of visible signaling systems of existing art and more specifically relates to seat occupancy indicators.

RELATED ART

Cruise ships, pools, and various other events provide a finite number of seating options to patrons. Preferred seating tends to be claimed quickly. Groups of patrons prefer to sit with each other which will occupy entire blocks of available seating options, thereby making large numbers of sequential seating options unavailable. A patron may have the necessity to leave a seat for various reasons, including a trip to the lavatory or to retrieve refreshments. To another patron this temporary abandonment of the seat may indicate an availability. Often conflict will occur over temporarily unoccupied seats. This conflict may result in unwanted hostilities and bring undue stress to a patron. Existing attempts to solve this problem have been unnecessarily complicated and may be cost prohibitive.

U.S. Pat. No. 6,140,921 to Herbert Eduard Baron relates to a seat occupancy indicator and seating area display system. The described is an indicator and display system for theaters, auditoriums and the like provides information regarding occupancy on individual seats and a display providing information relating to seat occupancy and relating to the seating area. The system includes multi-colored lights mounted on the tops of the seats for indicating the occupancy thereof. The lights are controlled by sensors mounted in the seats and manual switches mounted on the seats. The system also includes a display panel located in the lobby or near the theater or auditorium which shows which seats are occupied and which are vacant. The display panel also numerically shows the seat availability and also shows in hologram form the seating arrangement and the location of restrooms, refreshment counter, etc. relative to the seating area as well as aisles and other information of use to the patrons.

SUMMARY OF THE INVENTION

In view of the foregoing disadvantages inherent in the known seat occupancy device art, the present disclosure provides a novel seat occupancy indicator device and method. The general purpose of the present disclosure, which will be described subsequently in greater detail, is to provide an efficient and effective seat occupancy indicator device and method.

A seat occupancy indicator device is disclosed herein. The seat occupancy indicator device includes a housing (preferably comprising a rigid material); the housing having a housing-exterior and a housing-interior-volume. The seat occupancy indicator device further comprises a plurality of indicator lights; the plurality of indicator lights are disposed on the housing-exterior. The plurality of indicator lights are viewable from a location outside of the housing. The device further includes a control-circuit; the control-circuit is located within the housing-interior-volume. The control-circuit is communicatively coupled to the plurality of indicator lights. The seat occupancy indication device is configured to attach to a seat for indicating occupancy.

The housing further includes diffusion windows configured to diffuse illumination provided by the plurality of indicator lights. The face having the plurality of indicator lights is oriented perpendicular to a substantially horizontal surface when the device is attached to the seat; wherein the face is outwardly oriented relative to the seat when the attachment-member is attached to the seat.

According to another embodiment, a method of using a seat occupancy indicator device is also disclosed herein. The method of using a seat occupancy indicator device includes providing a seat occupancy indicator device, the seat occupancy indicator device comprising a housing, the housing comprising a rigid material, the housing having a housing-exterior and a housing-interior-volume, a plurality of indicator lights, the plurality of indicator lights disposed on the housing-exterior, the plurality of indicator lights viewable from a location outside of the housing, a control-circuit, the control-circuit located within the housing-interior-volume, the control-circuit communicatively coupled to the plurality of indicator lights, wherein the seat occupancy indication device is configured to attach to a seat for indicating occupancy; setting the timer-switch to a required predetermined time; attaching the device to the seat with the attachment-member; and another optional step according to a normal method of operation for using a seat occupancy indicator device, resetting the device with the reset-switch to enable, and alternatively disable, the predetermined time interval countdown.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a seat occupancy indicator device and method, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a seat occupancy indicator device and more particularly to a seat occupancy indicator device and method as used to improve the indication of seat occupancy.

Generally, the device is to indicate that a sun lounger or deck chair (or the like) is unavailable for use or readily available for use. The device would be designed to be a small light weight plastic box which would easily attach to sun loungers and deck chairs typically used on cruise ships and vacation resorts. The device would comprise of an internal switch inside the unit casing allowing management to adjust for 30, 60, 90-minute time intervals. The adjustments may be made to the internal timer mechanism through a tool unique only to the device. An internal timer (no user display or interface), counts down from the pre-programmed time. While time is counting down, a red LED indicator light remains illuminated, indicating to a potential user that the chair is currently in use/reserved. When countdown is complete, the red LED extinguishes and an adjacent green LED illuminates. The green light indicates to a prospective user that the chair is now available or has been unoccupied for the duration of the pre-programmed time. The device may further include energy saving features that disable the device completely when left idle for a predetermined time. The device features a counter reset button allowing the immediate user of the chair to reset the counter to its pre-programmed interval. When the user wants to temporarily leave the chair for; bathroom, swimming, snacks, any other short-term absence (within the pre-programmed time interval of the unit); the user depresses the 'reset' button which will illuminate the red light indicating to others that while there is no one physically in the chair, the user has not relinquished the chair and will return.

Referring now more specifically to the drawings by numerals of reference, there is shown in FIGS. 1-4, various views of a device 100.

Figure 1:
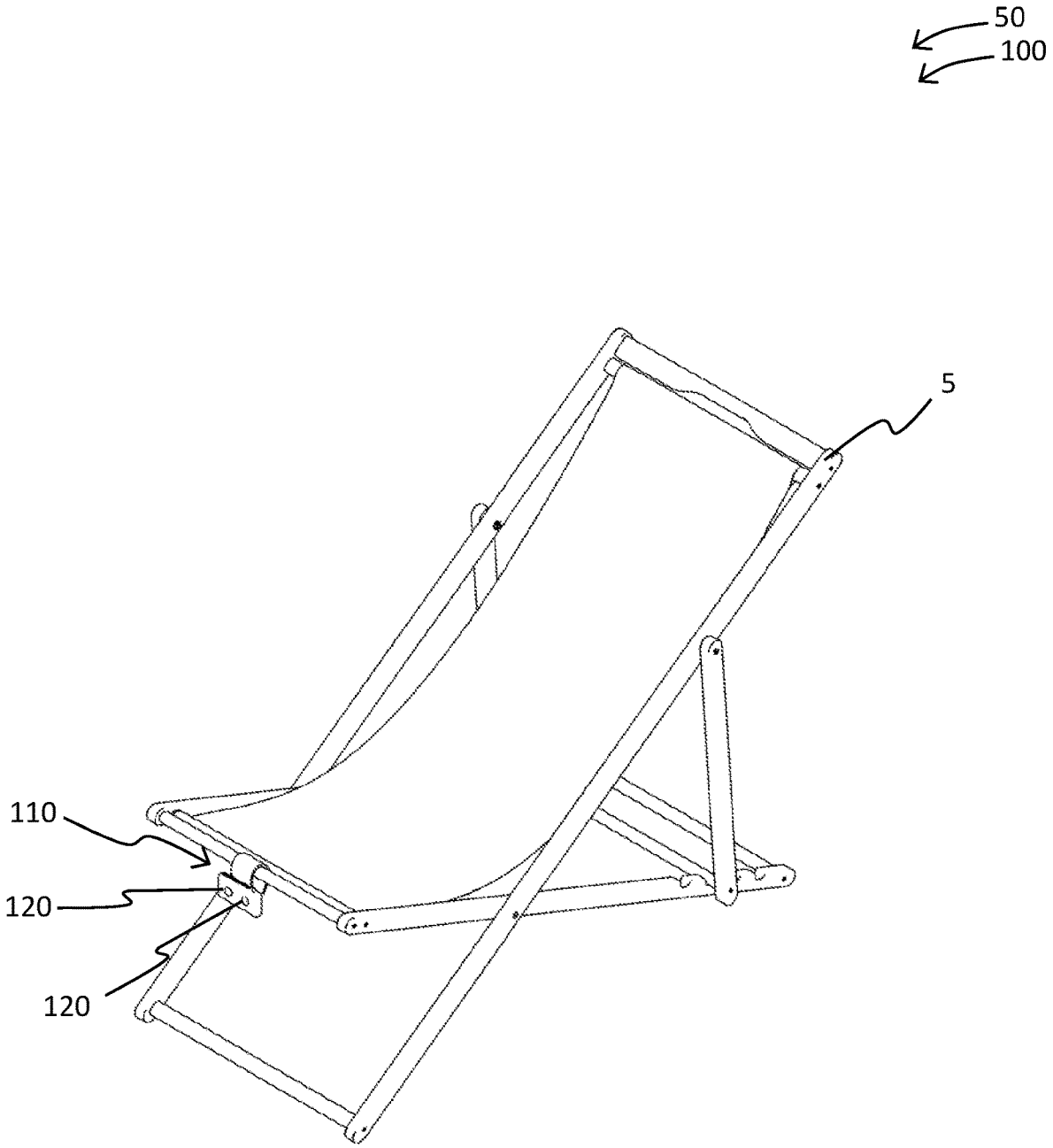
FIG. 1 is a perspective view of the seat occupancy indicator device during an 'in-use' condition, according to an embodiment of the disclosure.
Figure 2:
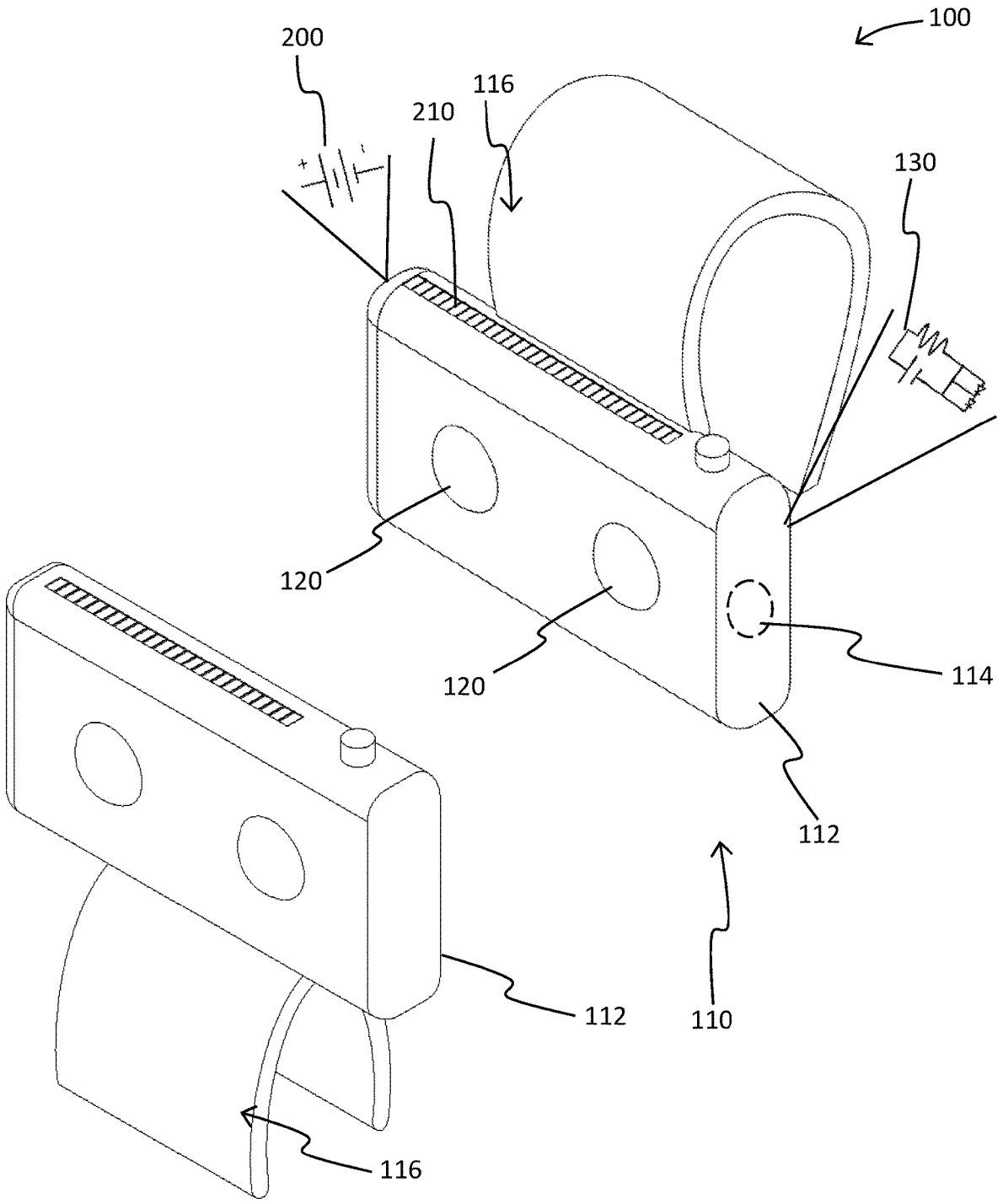
FIG. 2 is a perspective view of the seat occupancy indicator device of FIG. 1, according to an embodiment of the present disclosure.

FIG. 1 shows a device 100 during an 'in-use' condition 50, according to an embodiment of the present disclosure. Here, the device 100 may be beneficial for indicating seat occupancy. As illustrated, the device 100 may include a housing 110 comprised of a rigid material. The housing 110 has a housing-exterior 112 (FIG. 2) and a housing-interior-volume 114 (FIG. 2). Further, device 100 comprises a plurality of indicator lights 120, the plurality of indicator lights 120 disposed on the housing-exterior 112. The plurality of indicator lights 120 are viewable from a location outside of the housing. Further device 100 comprises a control-circuit 130 (FIG. 2), the control-circuit 130 is located within the housing-interior-volume 114. The control-circuit 130 is communicatively coupled to the plurality of indicator lights 120. The seat 5 occupancy indication device 100 is configured to attach to a seat 5 for indicating occupancy. The face 240 (FIG. 3) of the device 100 having the plurality of indicator lights 120 may be outwardly oriented relative to the seat when the attachment-member 116 (FIG. 2) is attached to the seat 5.

FIG. 2 shows the device 100 of FIG. 1, according to an embodiment of the present disclosure. As above, the device 100 may include a housing 110; the housing 110 is comprised a rigid material. The housing 110 has a housing-exterior 112 and a housing-interior-volume 114. The housing 110 includes an attachment-member 116 configured to attach the device 100 to the seat 5 (FIG. 1). The plurality of indicator lights 120 are disposed on the housing-exterior 112. The plurality of indicator lights 120 are viewable from a location outside of the housing 110. The plurality of indicator lights 120 may include at least one green light emitting diode. The plurality of indicator lights 120 may also include at least one red light emitting diode (other colors may be used). A control-circuit 130 is located within the housing-interior-volume 114. The control-circuit 130 is communicatively coupled to the plurality of indicator lights 120. The device 100 further includes a battery 200 communicatively coupled to the plurality of indicator lights 120 and the control-circuit 130. A photovoltaic cell array 210 may be configured to provide power to the plurality of indicator lights 120, the control-circuit 130 and charge the battery 200.

Further embodiments of the device 100 may comprise any conceived sizes and dimensions of the housing 110, attachment-member 116 and all corresponding components thereof. Conceived embodiments of the attachment-member 116 may include any means of fastening the device 100 to the seat 5 (FIG. 1) in a static position such that the plurality of indicator lights 120 may be readily visible. A preferred embodiment of the device 100 during an 'in-use' condition 50 (FIG. 1) may include the attachment-member 116 configured to the housing-exterior 112 enabling the device 100 to affix to a seat 5 where the plurality of indicator lights 120 may be unobstructed. In this preferred embodiment, the attachment-member 116 may be affixed to the housing-exterior 112 in varying orientations as further illustrated.

Figure 3:
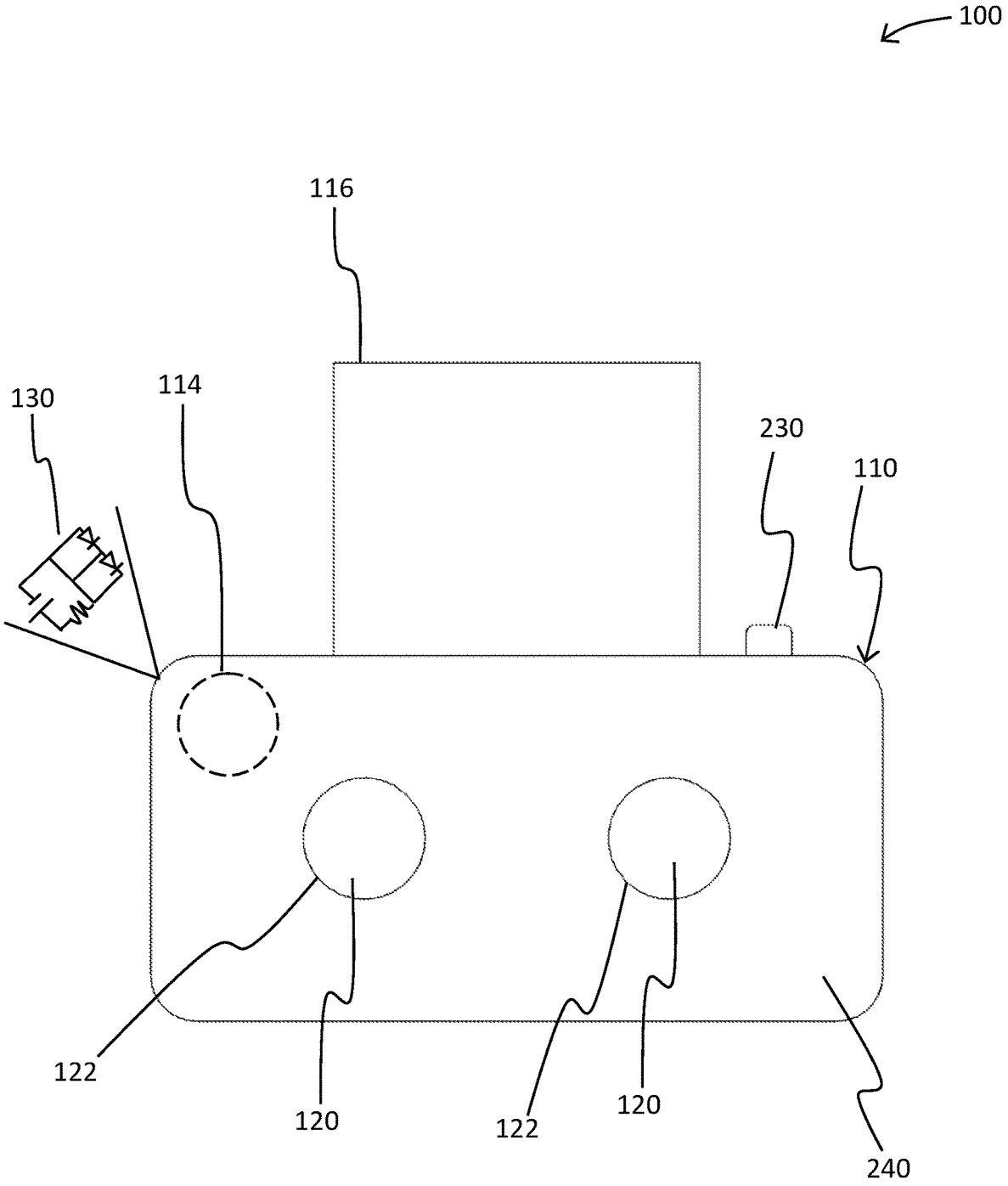
FIG. 3 is a front view of the seat occupancy indicator device of FIG. 1, according to an embodiment of the present disclosure.

Referring now to FIG. 3, a front view of the seat occupancy indicator device 100 of FIG. 1, according to an embodiment of the present disclosure. As shown, the device 100 includes a plurality of indicator lights 120 that are displayed in series on a face 240 of the housing 110. The housing 110 includes an attachment-member 116 configured to attach the device 100 to the seat 5 (FIG. 3). A control-circuit 130 is located within the housing-interior-volume 114 of the housing 110. The control-circuit 130 includes a timer (timing means) configured to enable, and alternatively disable, the at least one red light emitting diode, and alternatively, the at least one green light emitting diode after a predetermined time. The control-circuit 130 may further include an aperture configured for a reset-button 230; the reset-button 230 configured to enable, and alternatively, disable the timer. The housing 110 may further include diffusion windows 122 configured to diffuse the illumination provided by the plurality of indicator lights 120.

Figure 4:
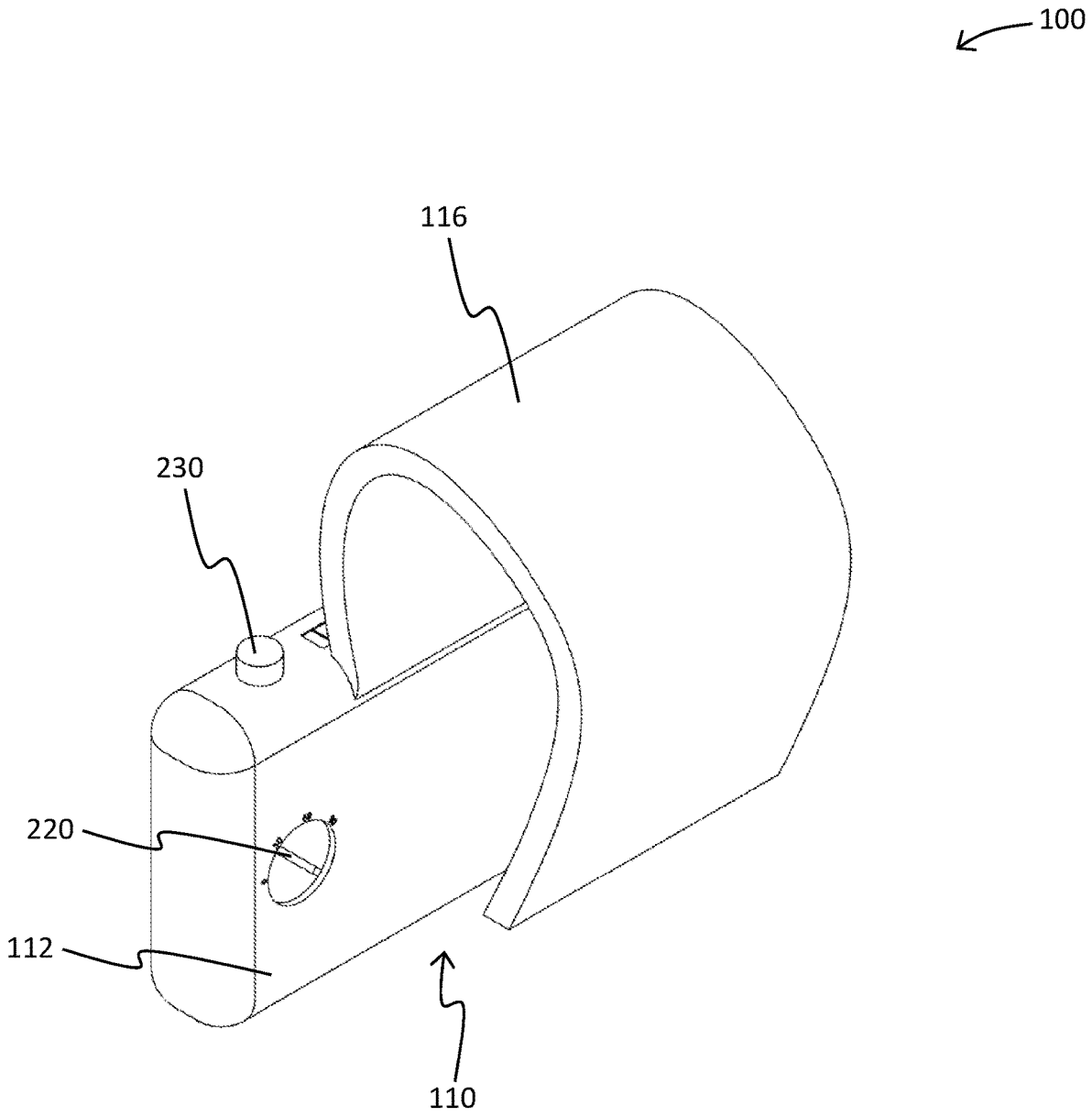
FIG. 4 is a rear perspective view of the seat occupancy indicator device of FIG. 1, according to an embodiment of the present disclosure.

FIG. 4 is a rear perspective view of the seat occupancy indicator device 100 of FIG. 1, according to an embodiment of the present disclosure. As shown the housing 110 of the device 100 includes an attachment-member 116 configured to attach the device 100 to a seat 5 (FIG. 1). The control-circuit 130 (FIG. 2) includes a timer configured to enable, and alternatively disable, the at least one red light emitting diode, and alternatively the at least one green light emitting diode after a predetermined time. A timer-switch 220 is accessible on the housing-exterior 112 configured to set the predetermined time. In a preferred embodiment, the timer-switch 220 may only be accessible via administrative privileges. As shown, the predetermined time includes, 30, 60 and 90-minute intervals. Other timing intervals may be used. Also shown is the reset-button 230 configured to enable, and alternatively, disable the timer.

Figure 5:
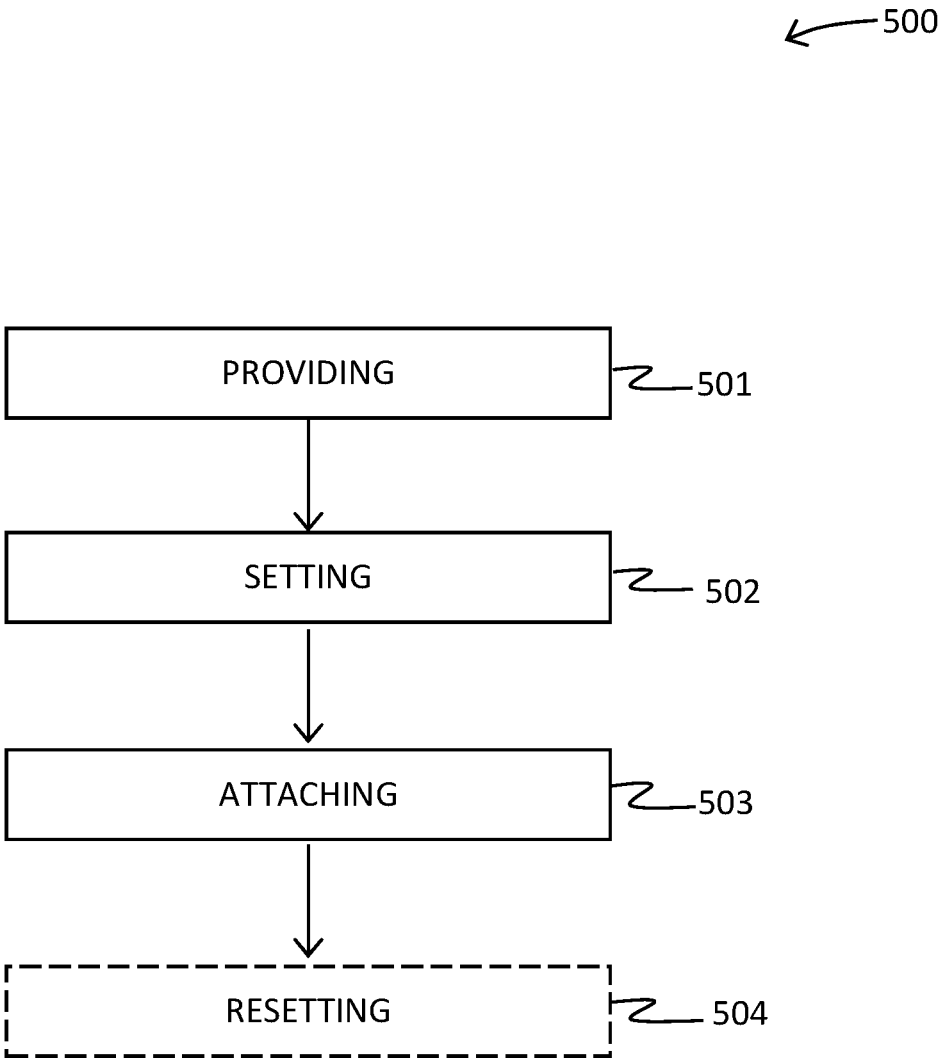
FIG. 5 is a flow diagram illustrating a method of using seat occupancy indicator device, according to an embodiment of the present disclosure.

Referring now to FIG. 5 showing a flow diagram illustrating a method for using 500 a seat occupancy indicator 100, according to an embodiment of the present disclosure. In particular, the method for using 500 a seat occupancy indicator 100 may include one or more components or features of the device 100 as described above. As illustrated, the method for using 500 a seat occupancy indicator device 100 may include the steps of: step one 501, providing a seat occupancy indicator device described herein; step two 502, setting the timer-switch to a required predetermined time; step three 503, attaching the device to the seat with the attachment-member; step four 504, resetting the device with the reset-switch to enable, and alternatively disable, the predetermined time interval countdown.

It should be noted that step 504 is an optional step and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for using a seat occupancy indicator, are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A seat occupancy indicator device comprising:

a housing removably attachable to a seat, wherein the housing comprises:

a chair available light configured to indicate that the seat is available, a chair-reserved light configured to indicate that the seat is occupied, a reset switch, and a timer;

the reset switch operably connected to the timer for creating a time interval in signal communication with the chair-reserved light, wherein actuation of the reset switch illuminates the chair-reserved light for the time interval and simultaneously deactivates the chair available light;

wherein the chair-reserved light is adapted to be continuously illuminated during the time interval and cannot be deactivated during the time interval;

wherein the chair available light is adapted to be continuously illuminated between a first time interval and a second time interval and only deactivated upon actuation of the reset switch;

wherein the chair available light is automatically illuminated once the time interval elapses;

a photovoltaic cell disposed on a top face of the housing configured to power both the chair-reserved light and the chair available light;

wherein the chair-reserved light and the chair available light are each a single light assembly disposed on a front face of the housing, wherein the front face is oriented perpendicular to the top face, such that the top face is configured to face upwards when the housing is secured to the seat;

wherein each light assembly comprises a diffusion window;

wherein the front face of the housing is unobstructed with any additional features;

wherein the timer is internal to the housing and comprises no user interface for modifying the time interval and no display for viewing a time on an exterior of the housing;

an attachment member extending from the housing and configured to gravity suspend the housing from the seat such that the top face remains oriented upwards.

2. The seat occupancy indicator device of claim 1, wherein the time interval is 30, 60, or 90 minutes.

3. The seat occupancy indicator device of claim 1, wherein the time interval is tamperproof, such that an unauthorized user is unable to adjust the time interval.

4. The seat occupancy indicator device of claim 1, wherein the housing further includes diffusion windows over the chair available light and the chair-reserved light.

5. The seat occupancy indicator device of claim 1, wherein the timer operation can only be initiated by the reset switch.

6. The seat occupancy indicator device of claim 1, wherein the housing is removably secured to the seat via an attachment member, wherein the attachment member is configured to form a loop around a horizontally disposed crossmember of the seat.

7. The seat occupancy indicator device of claim 1, wherein the chair-reserved light can only be illuminated when the reset switch is actuated.

8. The seat occupancy indicator device of claim 1, further comprising a timer switch configured to adjust the time interval, wherein the timer switch is only accessible via a key unique to the housing.

9. The seat occupancy indicator device of claim 1, further comprising a timer switch configured to adjust the time interval, wherein the timer switch is only accessible by a user having administrative privileges over the seat occupancy indicator device.

10. The seat occupancy indicator device of claim 1, further comprising an energy saving timer configured to deactivate both the chair-reserved light and chair available light when the reset switch remains unactuated for a predetermined period of time.

11. The seat occupancy indicator device of claim 1, wherein the housing comprises only a single control for activating the timer, the single control being the reset switch.

12. The seat occupancy indicator device of claim 1, further comprising the seat, wherein the seat is an outdoor chair having a seat portion, wherein the housing is secured to the seat portion.

13. The seat occupancy indicator device of claim 1, wherein the photovoltaic cell occupies a majority of a surface area of the top face of the housing.

14. The seat occupancy indicator device of claim 1, wherein each diffusion window is flush so not to protrude outward from the front face.

* * * * *